US006564727B1

(12) United States Patent
Kmiotek et al.

(10) Patent No.: US 6,564,727 B1
(45) Date of Patent: May 20, 2003

(54) METHOD AND APPARATUS FOR UPRATING AND CONTROLLING A SOLID FUEL PULVERIZED AND EXHAUSTER SYSTEM FOR A STEAM GENERATOR

(75) Inventors: Stanley E. Kmiotek, Tolland, CT (US); Gregory R. Strich, Enfield, CT (US)

(73) Assignee: Alstom Ltd., Baden (CH)

( * ) Notice: Subject to any disclaimer, the term of this patent is extended or adjusted under 35 U.S.C. 154(b) by 0 days.

(21) Appl. No.: 10/057,230

(22) Filed: Jan. 25, 2002

(51) Int. Cl.[7] ..... F23B 7/00; F23K 1/00

(52) U.S. Cl. ..... 110/341; 110/232; 110/106; 110/347; 110/342

(58) Field of Search ..... 110/232, 341, 110/342, 347, 101 R, 106; 60/39.06, 39.464

(56) References Cited

U.S. PATENT DOCUMENTS 4,355,586 A * 10/1982 Brown ..... 110/229
4,523,721 A * 6/1985 Maliszewski et al. ..... 241/61
4,550,563 A * 11/1985 Marchand ..... 60/39.06
4,754,932 A * 7/1988 Kmiotek et al. ..... 241/31
5,363,778 A * 11/1994 Kmiotek et al. ..... 110/232
5,799,592 A * 9/1998 Kmiotek et al. ..... 110/232
5,875,977 A * 3/1999 Kozlak et al. ..... 241/18
5,884,776 A * 3/1999 Piepho et al. ..... 209/714
5,976,224 A * 11/1999 Durant et al. ..... 95/268
6,024,311 A * 2/2000 Prairie et al. ..... 241/117
6,061,908 A * 5/2000 DeMarey et al. ..... 29/895.3

* cited by examiner

*Primary Examiner*—Ira S. Lazarus
*Assistant Examiner*—Kenneth B. Rinehart
(74) *Attorney, Agent, or Firm*—Russell W. Warnock

(57) ABSTRACT

A method for retrofitting a solid fuel pulverizer and exhauster system includes replacing the bowl drive motor 38 with a new drive motor which is operable to drivingly rotate the bowl 12 at the pre-retrofit speed but which provides relatively more horsepower than the replaced bowl drive motor 38 and replacing the original exhauster fan coupling with a new exhauster fan gear set 46, 48 which effects rotation of the exhauster fan 30 at a relatively higher rotational speed than the pre-retrofit speed. A solid fuel pulverizer and exhauster system of the present invention acting in cooperative association with a fuel-fired steam generating power plant includes an exhauster fan transmission assembly 50, 52 operable to translate the rotation of the drive shaft 54 of the exhauster fan drive motor 44 through ninety (90) degrees to thereby effect rotation of the fan by the exhauster fan drive motor 44.

7 Claims, 7 Drawing Sheets

METHOD AND APPARATUS FOR UPRATING AND CONTROLLING A SOLID FUEL PULVERIZED AND EXHAUSTER SYSTEM FOR A STEAM GENERATOR

BACKGROUND OF THE INVENTION

The present invention relates to a solid fuel pulverizer and exhauster system which is suitable for use in association with a fossil fuel-fired steam generator in a new utility unit application or a retrofit application in an existing utility unit.

Pulverizers are well known for the reduction of the particle size of solid fuel to allow for combustion of the solid fuel in a furnace. A pulverizer employs some combination of impact, attrition and crushing to reduce a solid fuel to a particular particle size. Several types of pulverizer mills can be employed for the pulverization of the solid fuel, for example, coal, to a particulate size appropriate for firing in a furnace. These can include ball-tube mills, impact mills, attrition mills, ball race mills, and ring roll or bowl mills. Most typically, however, bowl mills with integral classification equipment are employed for the pulverization of the solid fuel to allow for transport, drying, and direct firing of the pulverized fuel entrained in an air stream.

Bowl mills have a grinding ring carried by a rotating bowl. Fixed position rollers are mounted on roller journal assemblies such that the roll face of the rollers are approximately parallel to the inside surface of the grinding ring and define a very small gap therebetween. Pressure for grinding is applied through springs or hydraulic cylinders on the roller journal to crush solid fuel caught between the roll face of the roller and the grinding ring.

An air stream is typically utilized for drying, classification, and transport of the solid fuel through the pulverizer. The air stream employed is typically a portion of the combustion air referred to as the primary air. The primary air is combustion air first directed through a preheater whereby the combustion air is heated with energy recovered from the flue gas of the furnace. A portion of the primary air is then ducted to the pulverizers. In a bowl mill, the primary air is drawn through beneath the bowl of the bowl mill and up past the roller journal assemblies to collect the pulverized solid fuel. The small particles of solid fuel become entrained in the primary air. The air stream containing the solid fuel then passes through a classifier into the outlet of the pulverizer. After passing through the exhauster, the pulverized fuel can be stored, or more typically, is transported to the furnace by the air stream for direct firing.

A fan assembly, referred to as an exhauster, is used to pump the air stream through the pulverizer. The exhauster is conventionally positioned on the outfeed side of the pulverizer for drawing the primary air through the pulverizer. This arrangement of pulverizer and exhauster is referred to as a suction system. The capacity of a pulverizer is a function of the solid fuel properties, pulverizer size, and air flow through the pulverizer. In a suction system, where the exhauster induces air flow through the pulverizer, improvement of the performance of the exhauster will in some cases result in improvement in the performance of the pulverizer. In a suction system wherein an exhauster is positioned on the outfeed side of a bowl mill, the air stream outlet of the bowl mill is typically at an elevated position relative to the inlet of the exhauster. A duct directs the air stream of primary air and pulverized fuel from the outlet of the bowl mill downward and generally through an elbow in the duct of greater than (90) ninety degree angle into the inlet of the exhauster.

In the United States of America, federally mandated emissions limits and increased competitive pressures have motivated utility unit operators to change their existing coal supplies such that those types of coal which a particular utility unit had originally been designed to handle are now mixed with other types of coal or replaced completely by other types of coal. For example, some utility unit operators are contemplating switching to a rank of coal which has a relatively higher moisture, relatively lower heating content, and a relatively lower sulfur than the original design basis coal or mixing such different coal with the original design basis coal. However, such utility unit operators face the reality that the pulverized solid fuel feed components of their utility units, which comprise at least one pulverizer for pulverizing the coal and its associated air transport components such as an exhauster fan, are not capable of reliably performing the grinding and transport of such substitute coal or substitute coal and original design coal mixtures. In some instances, the existing pulverizers and their associated air transport components do not have, or cannot be adjusted to provide, the increased throughput required for the use of such substitute coal or substitute coal mixtures.

The need thus exists for a solid fuel pulverizer and exhauster system which can reliably handle, in cooperation with other components, the solid fossil fuel grinding and air transport requirements of existing utility units which a utility unit operator desires to retrofit so as handle such relatively higher moisture, relatively lower heating content, and a relatively lower sulfur coal.

SUMMARY OF THE INVENTION

To thus summarize, a need has been evidenced in the prior art for a solid fuel pulverizer and exhauster system that would be particularly suited for use in effecting the pulverization of material such as, for example, coal.

It is, therefore, an object of the present invention to provide a new and improved solid fuel pulverizer and exhauster system for effecting the pulverization of material such as, for example, coal.

Yet another object of the present invention is to provide such a solid fuel pulverizer and exhauster system which is capable of being retrofitted in connection with existing bowl mills.

In accordance with one aspect of the present invention, these and other objects of the present invention are achieved by a method for retrofitting a solid fuel pulverizer and exhauster system including at least one pulverizer acting in cooperative association with a fuel-fired steam generating power plant which includes a furnace, the at least one pulverizer operative for pulverizing material into smaller particles, the pulverizer including a rotating vertical spindle supported therewithin, a grinding table supported on the vertical spindle for rotation thereby, at least one grinding roll operable to exert a grinding force on material disposed on the grinding table for effecting the pulverization thereof, a bowl drive means for rotating the vertical spindle, a mill gear set for operably interconnecting the vertical spindle and the bowl drive means, and classifier means for classifying the pulverized solid fuel between a discharge condition in which some of the pulverized solid fuel is suitable for discharge from the at least one pulverizer to the furnace and a non-discharge condition in which the remaining pulverized solid fuel is retained in the at least one pulverizer for further pulverizing, an exhauster assembly having an exhauster housing defining an inlet opening and a fan rotatably mounted in the exhauster housing, the fan providing an air stream, fan drive means for drivingly rotating the fan, and an exhauster fan coupling for operably interconnecting the fan and the fan drive means taken from the bowl drive motor and gear train and a duct interconnecting the exhauster assembly and the furnace for the feed of pulverized solid fuel therealong from the exhauster assembly to the furnace. In accordance with the one aspect of the present invention, the method includes replacing the bowl drive motor with a new drive motor which is operable to drivingly rotate the bowl at the pre-retrofit speed but which provides relatively more horsepower than the replaced bowl drive motor and replacing the original exhauster fan drive coupling with a new exhauster fan gear set which effects rotation of the exhauster fan at a relatively higher rotational speed than the pre-retrofit speed and can be driven by a separate drive motor of a single operating speed or arranged with a variable speed controller.

In accordance with another aspect of the present invention, the objects of the present invention are achieved by a method for retrofitting a solid fuel pulverizer and exhauster system including at least one pulverizer acting in cooperative association with a fuel-fired steam generating power plant which includes a furnace, the at least one pulverizer operative for pulverizing material into smaller particles, the pulverizer including a rotating vertical spindle supported therewithin, a grinding table supported on the vertical spindle for rotation thereby, at least one grinding roll operable to exert a grinding force on material disposed on the grinding table for effecting the pulverization thereof, a bowl drive means for drivingly rotating the vertical spindle, a mill gear set for operably interconnecting the vertical spindle and the bowl drive means, and classifier means for classifying the pulverized solid fuel between a discharge condition in which some of the pulverized solid fuel is suitable for discharge from the at least one pulverizer to the furnace and a non-discharge condition in which the remaining pulverized solid fuel is retained in the at least one pulverizer for further pulverizing, an exhauster assembly having an exhauster housing defining an inlet opening and a fan rotatably mounted in the exhauster housing, the fan providing an air stream, fan drive means for drivingly rotating the fan, an exhauster fan gear set for operably interconnecting the fan and the fan drive means, and a duct interconnecting the exhauster assembly and the furnace for the feed of pulverized solid fuel therealong from the exhauster assembly to the furnace. In accordance with this other aspect of the present invention, the method includes replacing the original bowl drive motor with a new drive motor which is operable to drivingly rotate the input drive gear at a speed higher than the pre-retrofit speed and which provides relatively more horsepower than the replaced bowl drive motor, replacing the original mill gear set with a new mill gear set operable to rotate the bowl at the original rotational speed while the input gear rotates at a relatively higher speed. With this arrangement, the exhauster drive motivation is taken from a direct coupling to the bowl drive input gear which effects rotation of the exhauster fan at a relatively higher rotational speed than the pre-retrofit speed.

In accordance with a further aspect of the present invention, the objects of the present invention are achieved by a solid fuel pulverizer and exhauster system acting in cooperative association with a fuel-fired steam generating power plant which includes a furnace. The solid fuel pulverizer and exhauster system includes at least one pulverizer operative for pulverizing material into smaller particles, the pulverizer including a rotating vertical spindle supported therewithin, a grinding table supported on the vertical spindle for rotation thereby, at least one grinding roll operable to exert a grinding force on material disposed on the grinding table for effecting the pulverization thereof, a bowl drive means for drivingly rotating the vertical spindle, a mill gear set for operably interconnecting the vertical spindle and the bowl drive means, and classifier means for classifying the pulverized solid fuel between a discharge condition in which some of the pulverized solid fuel is suitable for discharge from the at least one pulverizer to the furnace and a non-discharge condition in which the remaining pulverized solid fuel is retained in the at least one pulverizer for further pulverizing. The solid fuel pulverizer and exhauster system also includes an exhauster assembly having an exhauster housing defining an inlet opening and a fan, rotatably mounted in the exhauster housing, the fan providing an air stream, an exhauster fan drive motor having a drive shaft, the exhauster fan drive motor for drivingly rotating the fan, and an exhauster fan transmission assembly for operably interconnecting the fan and the exhauster fan drive motor, the exhauster fan transmission assembly being operable to translate the rotation of the drive shaft of the exhauster fan drive motor through ninety (90) degrees to thereby effect rotation of the fan by the exhauster fan drive motor of a single speed or which may be arranged with a variable speed control and soft start capability. The solid fuel pulverizer and exhauster system also includes and a duct interconnecting the exhauster assembly and the furnace for the feed of pulverized solid fuel therealong from the exhauster assembly to the furnace.

Other objects of the invention will become apparent from review of the specification and drawings.

DESCRIPTION OF THE PREFERRED EMBODIMENT

The solid fuel pulverizer and exhauster system the present invention is particularly suitable for large scale direct fired utility applications in which a steam generator is supplied with pulverized solid fossil fuel such as coal from a plurality of pulverizers, each pulverizer having a throughput typically in the range of 3,550 to 106,000 pounds per hour (lbs./hour). The solid fuel pulverizer and exhauster system of the present invention has applicability both in new utility units as well as in retrofit applications in which the pulverized solid fuel feed components of an existing utility unit are refurbished to prolong their ability to deliver pulverized solid fuel at the existing capacities or are modified to enhance or increase the performance of these components.

In the United States of America, federally mandated emissions limits and increased competitive pressures have motivated utility unit operators to change their existing coal supplies such that those types of coal which a particular utility unit had originally been designed to handle are now mixed with other types of coal or replaced completely by other types of coal. For example, some utility unit operators are contemplating switching to a type of coal which has a relatively higher moisture, relatively lower heating content, and a relatively lower sulfur than the original design basis coal or mixing such different coal with the original design basis coal. However, such utility unit operators face the reality that the pulverized solid fuel feed components of their utility units, which comprise at least one pulverizer for pulverizing the coal and its associated air transport components such as an exhauster fan, are not capable of reliably performing the grinding and transport of such substitute coal or substitute coal and original design coal mixtures. In some instances, the existing pulverizers and their associated air transport components do not have, or cannot be adjusted to provide, the increased throughput required for the use of such substitute coal or substitute coal mixtures.

The solid fuel pulverizer and exhauster system of the present invention is designed to reliably handle, in cooperation with other components, the solid fossil fuel grinding and air transport requirements of both new utility units designed to fire such relatively higher moisture, relatively lower heating content, and a relatively lower sulfur coal and existing utility units which a utility unit operator desires to retrofit so as handle such relatively higher moisture, relatively lower heating content, and a relatively lower sulfur coal. There is hereinafter described an embodiment, a further embodiment, and an additional embodiment of the solid fuel pulverizer and exhauster system of the present invention, each of which is suitable for at least a new utility unit application or a retrofit application in an existing utility unit.

Figure 1:
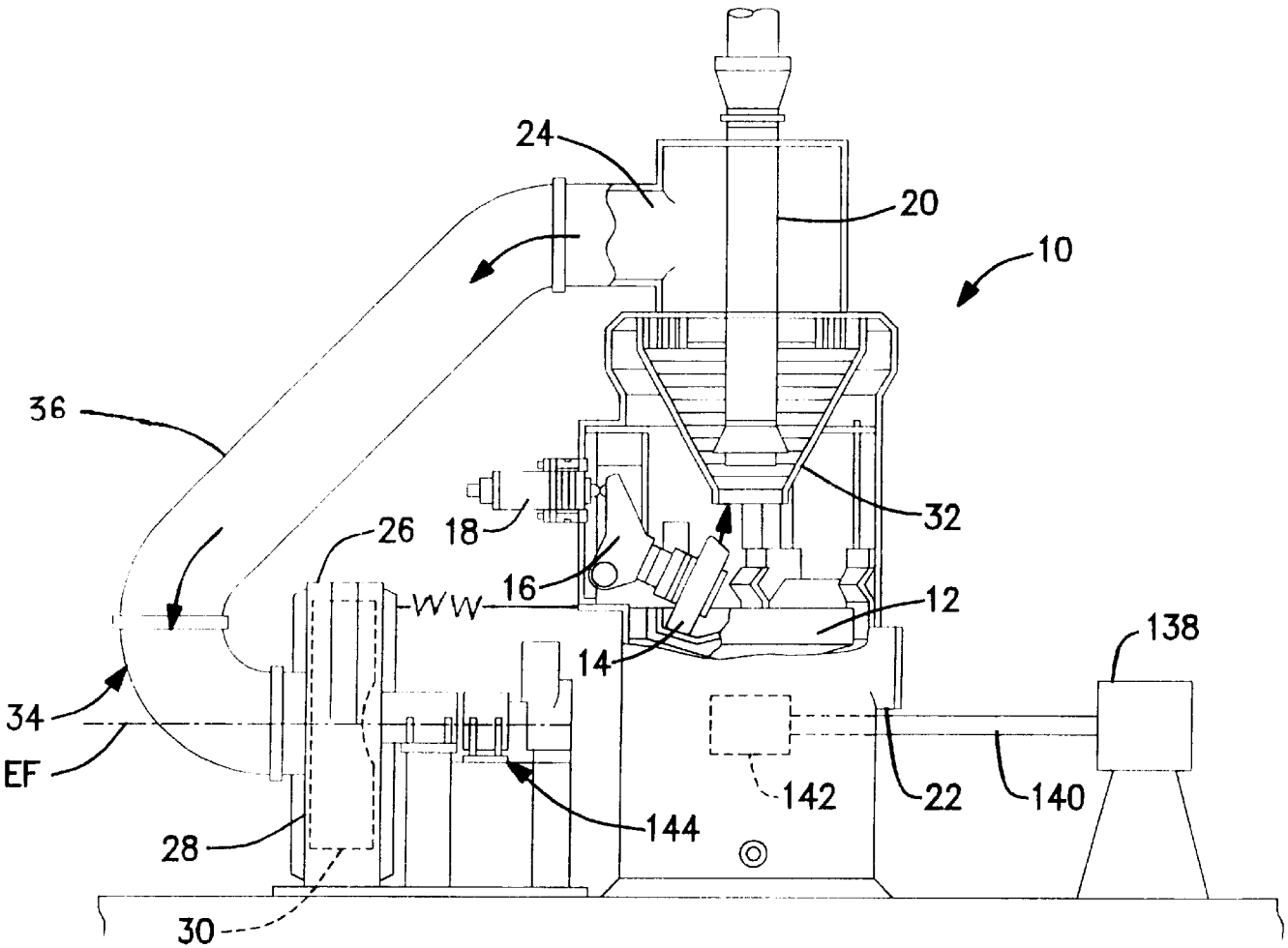
FIG. 1 is a front elevational view of one embodiment of the solid fuel pulverizer and exhauster system of the present invention.

Referring to FIG. 1 of the drawing, which is a front elevational view of one embodiment of the solid fuel pulverizer and exhauster system of the present invention, the one embodiment of the solid fuel pulverizer and exhauster system comprises a mill bowl mill 10 having a rotating grinding table or bowl 12 oriented to define a generally vertical axis of rotation. The bowl 12 supports an angled replaceable grinding surface on the interior of the bowl. A roller journal 16 rotatably supports a roller 14 over the grinding surface of the bowl 12. A pressure mechanism 18, such as a spring or hydraulic cylinder, biases the roller 14 toward the grinding surface 13 of the bowl 12. Positioned above the bowl 12 is a solid fuel supply tube 20 for supplying a solid fuel to the central portion of the bowl 12.

The bowl mill 10 defines an air inlet 22 for the entry of primary air beneath the bowl 12. The bowl mill 10 further defines an air stream outlet 24 positioned above the bowl 12. An exhauster 26, positioned in a suction arrangement, draws primary air through the bowl mill 10. A duct 36 defines an air flow path (see arrows of FIG. 1) between the outlet 24 of the bowl mill 10 and an inlet 28 of the exhauster 26. The exhauster 26 employs a rotating fan 30 for drawing the primary air through the bowl mill 10. The fan 30 is drivingly rotated about a fan axis FA by an exhauster fan drive motor (which is described in more detail hereinafter). The incoming primary air is preferably heated by use of a preheater (not shown) transferring heat from the outgoing flue gas of the furnace to the incoming combustion air. The primary air is then drawn through the air inlet 22 below the bowl 12 and upward around the outside of the bowl 12. Pulverized solid fuel becomes entrained in the primary air to form an air stream.

The air stream is drawn further upward through a classifier 32 for the classification of the entrained solid fuel. The air stream is withdrawn from the top of the bowl mill 10 through the air stream outlet 24. A duct 36 directs the air stream from the air stream outlet 24 to a curved inlet guide vane assembly 34 communicated with the inlet 28 of the exhauster 26. The classifier 32 can be any suitable conventional classifier including a dynamic classifier having a rotating cage or a static, non-rotating classifier.

The feed of coal by the one embodiment of the solid fuel pulverizer and exhauster system of the present invention shown in FIG. 1 to a steam generator is controlled in accordance with a fuel feed control arrangement. The fuel feed control arrangement may include one or more of the following features: (1) controlling the coal flow delivery to the pulverizer or pulverizers by metering of raw coal from a raw coal supply location via a gravimetric or volumetric type feeder, whereby the feed rate is controlled as a function of the fuel master demand; (2) controlling the airflow entering each respective pulverizer as a function of a set point selected in dependence upon a ramped function of the coal delivery rate; (3) additionally controlling the airflow by the use of upstream dampers or variable speed control of the exhauster fan; and (4) controlling the classifier speed as a function of predetermined classifier speed values determined by parametric testing and as a ramped function of the coal feed rate and the airflow.

A variation of the one embodiment of the solid fuel pulverizer and exhauster system shown in FIG. 1 will now be described with regard to FIGS. 2, 3, and 4. This variation includes a different drive arrangement for the exhauster fan of the exhauster 26 than that of the one embodiment of the solid fuel pulverizer and exhauster system shown in FIG. 1. Initially, to describe in detail the drive arrangement of the variation of the one embodiment of the solid fuel pulverizer and exhauster system shown in FIGS. 2, 3, and 4, reference will now be had to FIG. 2, which is an enlarged rear elevational view in partial section of the one embodiment of the solid fuel pulverizer and exhauster system shown in FIG. 1, FIG. 3, which is an enlarged top view in partial section of the one embodiment of the solid fuel pulverizer and exhauster system shown in FIG. 1, and FIG. 4, which is an enlarged side elevation view of a portion of the one embodiment of the solid fuel pulverizer and exhauster system shown in FIG. 1, taken along lines IV—IV of FIG. 2. A bowl drive motor 38 drivingly rotates a drive shaft 40 which, in turn, drivingly rotates a bowl gear set 42. The bowl gear set 42 includes a driven gear secured to the vertical spindle of the bowl 12 and a worm gear secured to the drive shaft 40 which meshingly engages the driven gear to thereby effect driving rotation of the bowl 12 about the axis of its vertical spindle.

An exhauster fan drive motor 44 drivingly rotates a drive shaft 46 about a drive shaft axis DS. As seen in particular in FIG. 3, an input gear 48 of a right angle gear set 50 is secured to the distal end of the drive shaft 46, whereby the input gear 48 is drivingly rotated by the drive shaft 46 about the drive shaft axis DS. The right angle gear set 50 also includes an output gear 52 mounted on the distal end of a fan shaft 54. The blades of the fan 30 are secured to the fan shaft 54 at uniform circumferential spacings therearound. The fan shaft 54 is drivingly rotated by the output gear 52 about the fan axis FA which is oriented perpendicularly (90 degrees) to the drive shaft axis DS. The included angle NN between the fan axis FA and the drive shaft axis DS is therefore ninety (90) degrees. Thus, the right angle gear set 50 is operable to translate the rotation of the drive shaft 46 of the exhauster fan drive motor 44 through ninety (90) degrees to thereby effect rotation of the fan 30 by the exhauster fan drive motor 44. The arrangement of the exhauster fan drive motor 44, the right angle gear set 50, and the fan 30 is particularly advantageous for deployment in the retrofitting of an existing utility unit in which the relatively close proximity of the bowl mill and the exhauster to one another precludes a mounting arrangement in which the drive shaft of the exhauster fan drive motor can be co-axial with the axis of the exhauster fan. For example, with reference to FIG. 3, if it is has been determined that the exhauster fan drive motor 44 is a suitable exhauster fan drive motor having the requisite performance features (e.g., sufficient horsepower, torque, and/or reliability) and the exhauster fan drive motor 44 has an overall length LL as measured parallel to the drive shaft axis DS, then it can be seen that it is not possible to mount the exhauster fan drive motor 44 with the drive shaft axis DS co-axial with the fan axis FA if the clearance CC between the bowl mill 10 and the exhauster 26 is less than the overall length LL of the exhauster fan drive motor 44. In other words, by virtue of the fact that the overall length LL of the exhauster fan drive motor 44 is greater than the clearance CC between the bowl mill 10 and the exhauster 26, an in-line or coaxial mounting of the exhauster fan drive motor 44 and the fan 30 is not possible.

However, the present invention permits the installation of a suitable exhauster fan drive motor having the desired performance features of, for example, sufficient horsepower, torque, and reliability (such as the exhauster fan drive motor 44) for driving the rotation of the fan 30 independent of the driving rotation of the bowl 12 by the bowl drive motor 38 by deployment of a suitable power transmission assembly such as the right angle gear set 50. Specifically, it can be seen that, since the length GG of the right angle gear set 50 as measured parallel to the axis of its output gear 52 is less than the clearance CC between the bowl mill 10 and the exhauster 26, the right angle gear set 50 can be installed as a suitable power transmission assembly to transmit the rotation of the drive shaft 46 of the exhauster fan drive motor 44 to the fan 30 to effect driving rotation thereof.

Figure 2:
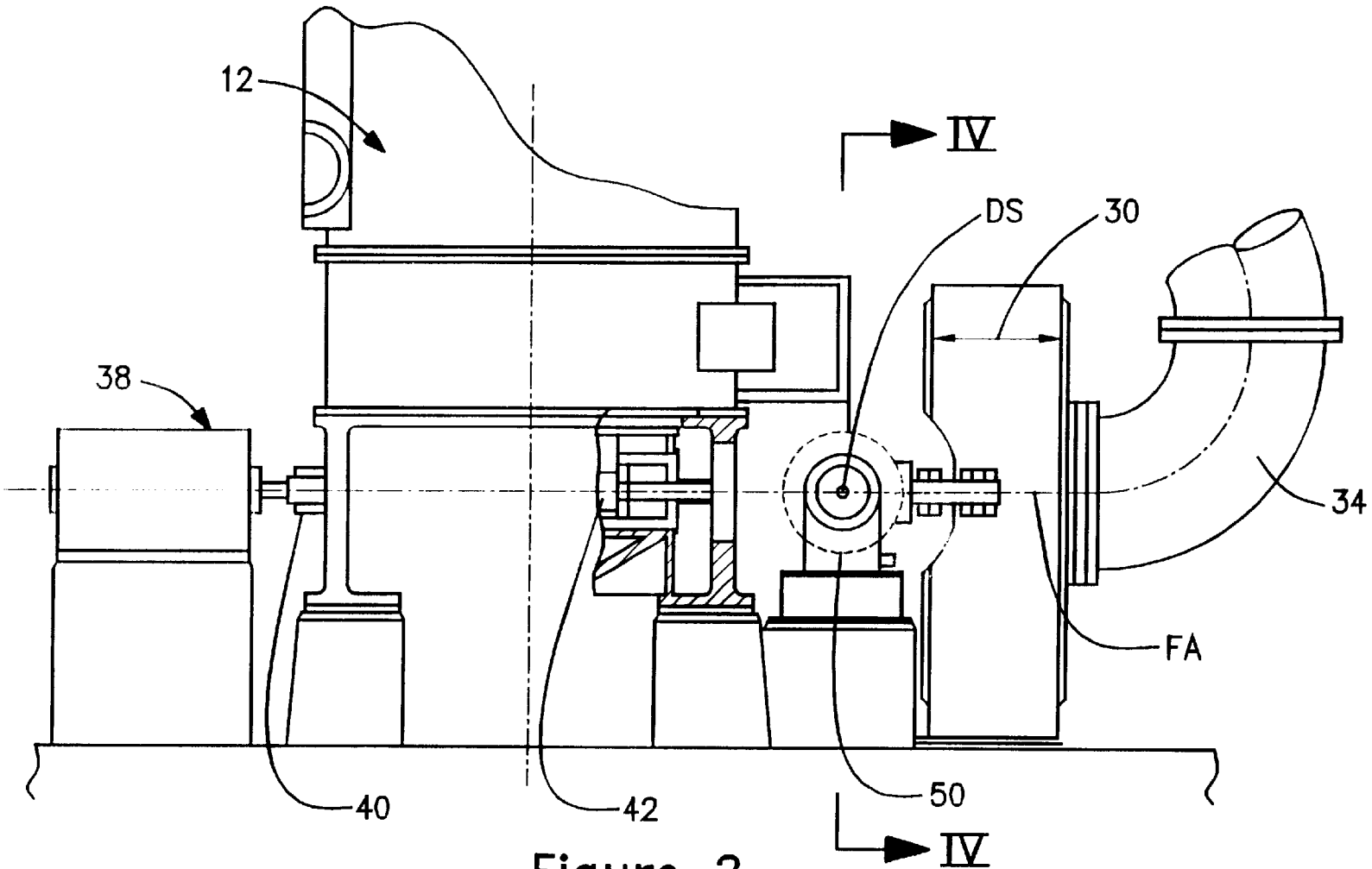
FIG. 2 is an enlarged rear elevational view in partial section of the one embodiment of the solid fuel pulverizer and exhauster system shown in FIG. 1.
Figure 3:
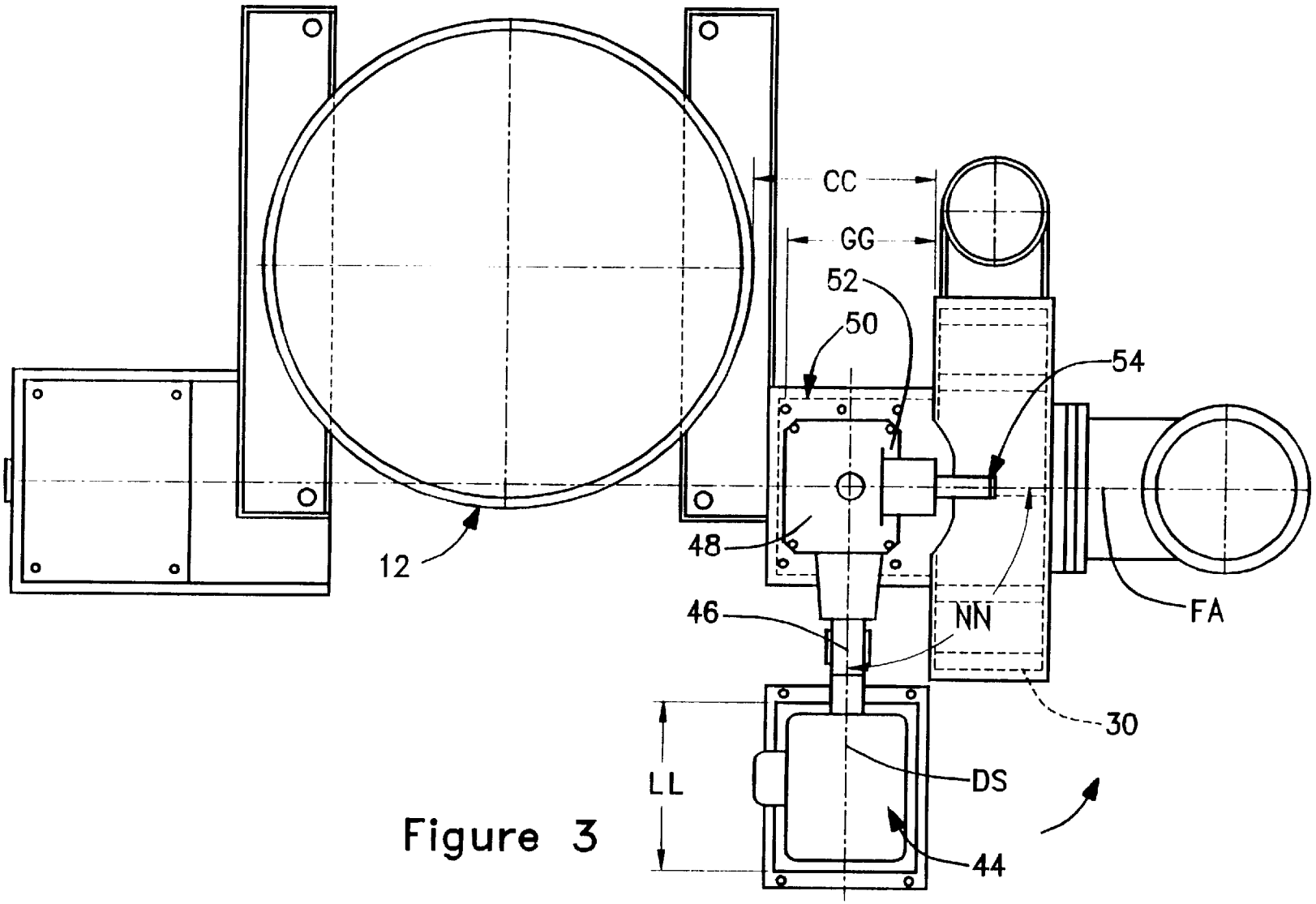
FIG. 3 is an enlarged top view in partial section of the one embodiment of the solid fuel pulverizer and exhauster system shown in FIG. 1.
Figure 4:
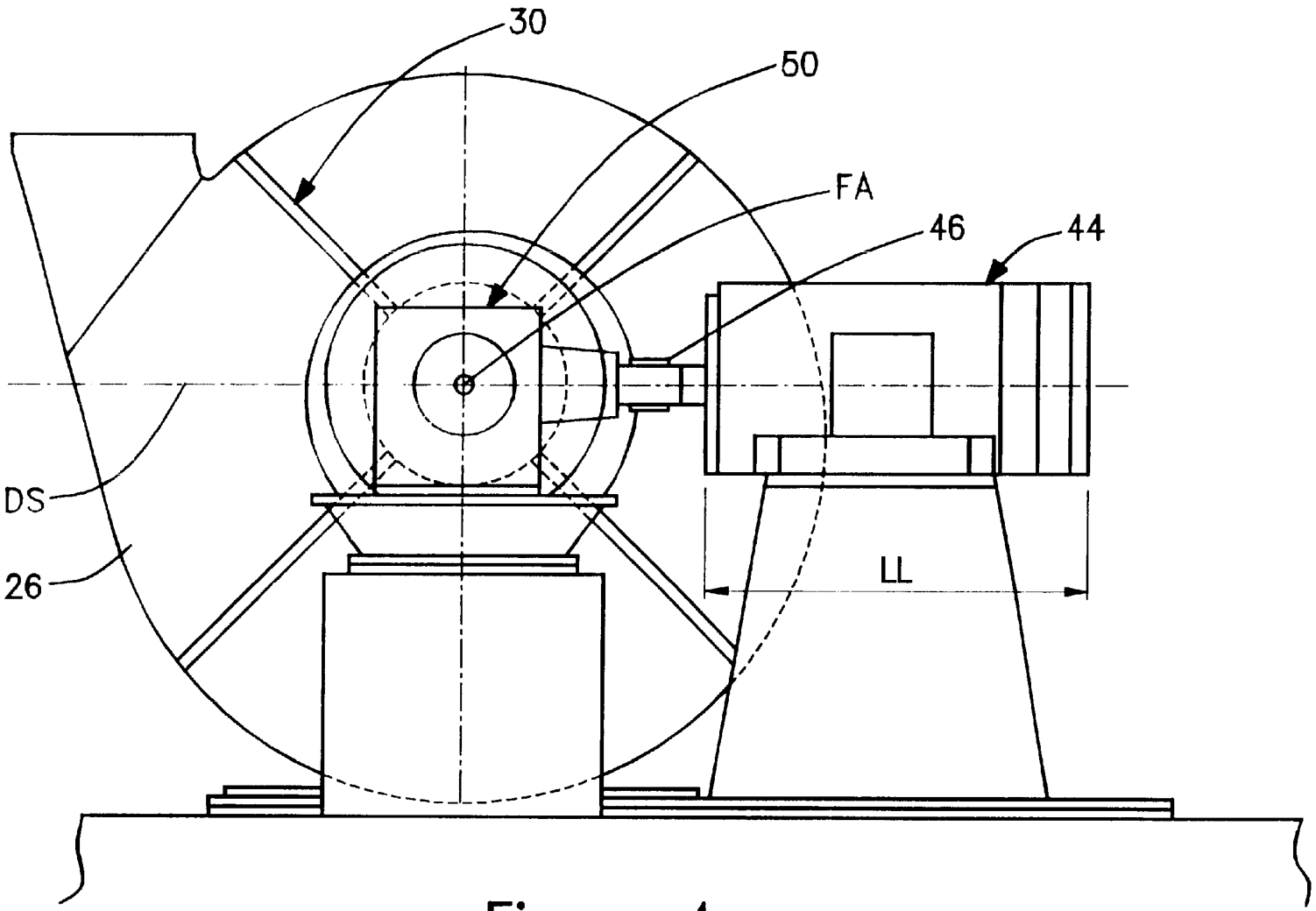
FIG. 4 is an enlarged side elevational view of a portion of the one embodiment of the solid fuel pulverizer and exhauster system shown in FIG. 1, taken along lines IV—IV of FIG. 2.

Reference is now had again to FIG. 1 to describe the different exhauster fan drive arrangement thereof as compared to the exhauster fan drive arrangement described with respect to FIGS. 2, 3, and 4. A bowl drive motor 138 drivingly rotates a drive shaft 140 which, in turn, drivingly rotates a bowl gear set 142. The bowl gear set 142 includes a driven gear secured to the vertical spindle of the bowl 12 and a worm gear secured to the drive shaft 140 which meshingly engages the driven gear to thereby effect driving rotation of the bowl 12 about the axis of its vertical spindle.

The exhauster fan 30 has a plurality of blades mounted at uniform circumferential spacings about a hub and is supported within the housing of the exhauster 26 for rotation about the fan axis of rotation FA defined by the axis of the hub. It can be seen that, in the solid fuel pulverizer and exhauster system shown in FIG. 1, a sufficient clearance WW exists between the exhauster 26 and the bowl mill 10 to permit a co-axial arrangement of the drive shaft of an exhauster fan drive motor and the fan axis of rotation FA, in contrast to the variation of the solid fuel pulverizer and exhauster system shown in FIGS. 2, 3, and 4 in which the clearance CC is insufficient to permit such a co-axial arrangement of the drive shaft 46 of the exhauster fan motor 44 and the exhauster fan 30. Thus, in the solid fuel pulverizer and exhauster system shown in FIG. 1, an exhauster fan drive motor 144 is mounted in the clearance WW between the exhauster 26 and the bowl mill 10 and the exhauster fan drive motor 144 drivingly rotates a drive shaft about a drive shaft axis which is co-axial with the axis of rotation FA of the exhauster fan 130.

The retrofitting or refurbishment of an existing utility unit with the one embodiment of the solid fuel pulverizer and exhauster system of the present invention is accomplished as a function of the existing layout of each respective existing pulverizer and its associated air transport components which comprise the exhauster. If the pulverizer and its associated exhauster are commonly drivingly coupled to a single drive shaft driven by a single drive motor, several retrofit configurations are possible. If the existing or original mill gear set such as the mill gear set 42, can effect the desired rotation of the bowl 12 and if the existing or original bowl drive motor can provide the requisite rotational drive of the bowl 12, then it is possible, in one retrofit configuration, to replace the common drive shaft with a drive shaft which only powers the mill gear set (in other words, the exhauster fan is no longer commonly drivingly coupled to the same drive shaft as the bowl). Additionally, in this one retrofit configuration, a suitable independent drive arrangement is provided for the exhauster fan such as, for example, the exhauster fan drive motor 44, to drive the exhauster fan independent of the rotational requirements of the bowl 12. The exhauster fan drive motor can be a single speed or a variable speed motor. As noted, a suitable power transmission assembly which offers space saving capabilities such as, for example, the right angle gear set 50, can be provided as well to operationally interconnect the exhauster fan drive motor and the exhauster fan. As an alternative to a right angle gear set, other space saving power transmission assemblies can instead be used such as, for example, a worm gear arrangement, fluid coupling, or a hypoid arrangement.

On the other hand, if the existing or original mill gear set, such as the mill gear set 42, cannot satisfactorily effect the desired rotation of the bowl 12 and/or if the existing or original bowl drive motor cannot provide the requisite rotational drive of the bowl 12, then other retrofit configurations are possible. For example, one possible retrofit configuration involves: (1) replacing the bowl drive motor with a new drive motor which is operable to drivingly rotate the bowl at the pre-retrofit speed but which provides relatively more horsepower than the replaced bowl drive motor; (2) using the existing or original mill gear set, and (3) replacing the existing or original exhauster fan gear set with a new exhauster fan gear set which effects rotation of the exhauster fan at a relatively higher rotational speed than the pre-retrofit speed. Another possible retrofit configuration in which the existing or original common drive shaft remains in operation involves: (1) replacing the existing or original bowl drive motor with a new drive motor which is operable to drivingly rotate the bowl at a speed higher than the pre-retrofit speed and which provides relatively more horsepower than the replaced bowl drive motor; (2) replacing the existing or original mill gear set and ratio with a new mill gear set operable to rotate the bowl at speed consistent with the pre modification on the output with a higher rotational speed than its pre-retrofit speed on the input gear also-used to drive the exhauster fan, and (3) replacing the existing or original exhauster coupling with a new exhauster fan gear set which effects rotation of the exhauster fan at a relatively higher rotational speed than the pre-retrofit speed. Additionally, as required, the exhauster fan wheel, which comprises the rotating fan blades and the hub on which they are mounted, can be replaced with a high efficiency exhauster fan wheel. The new exhauster fan gear set can be selected to increase the fan rotational speed from, for example, 900 revolutions per minute (rpm) to 1200 revolutions per minute (rpm).

Figure 5:
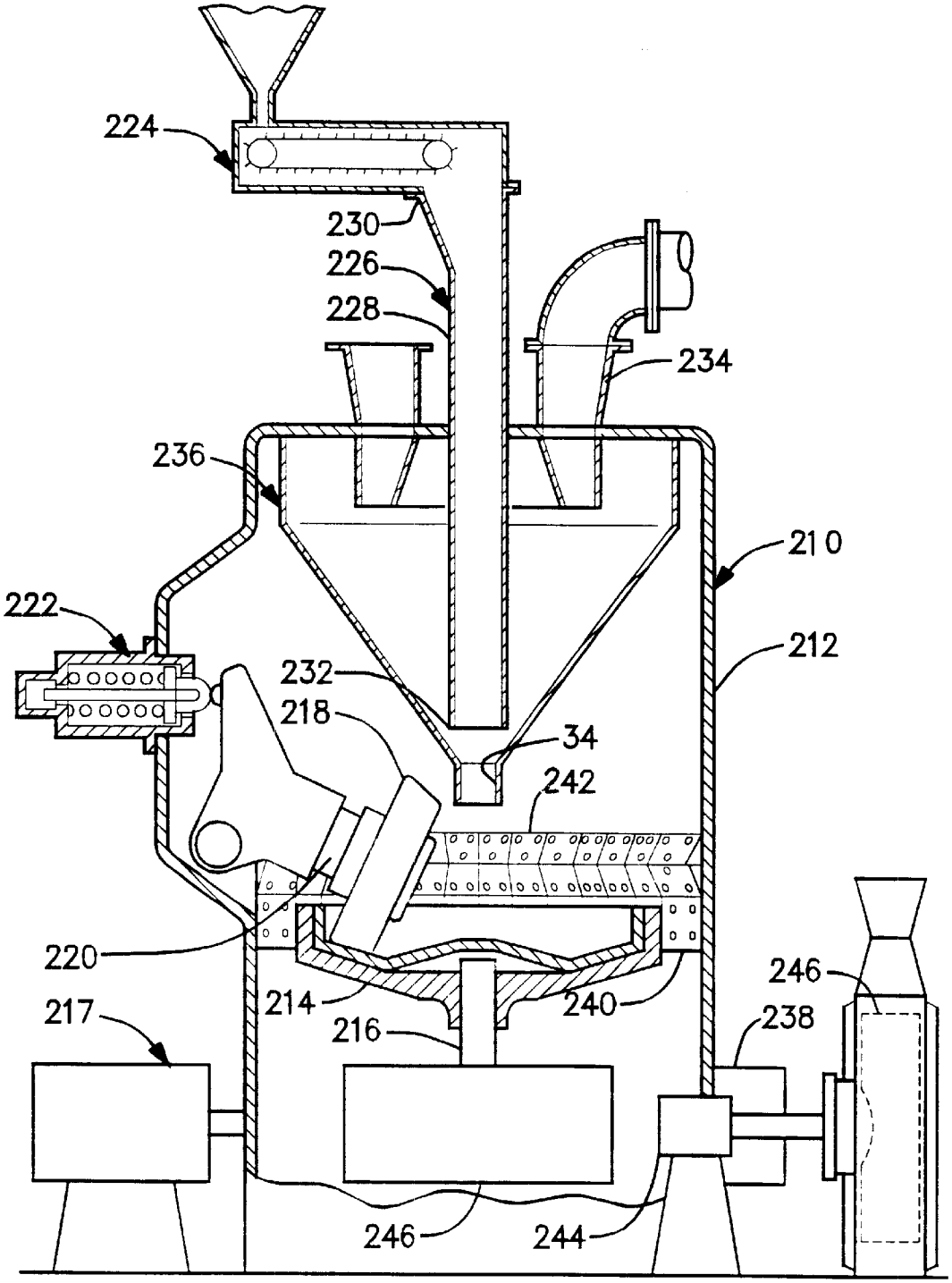
FIG. 5 is a front elevational view of a further embodiment of the solid fuel pulverizer and exhauster system of the present invention.

Referring to FIG. 5 of the drawings, a further embodiment of the solid fuel pulverizer and exhauster system of the present invention is illustrated which is exemplary of a retrofit application in accordance with the present invention. The further embodiment of the solid fuel pulverizer and exhauster system comprises a bowl mill 210 having a substantially closed separator body 212. A grinding table 214 is mounted on a shaft 216, which in turn is operatively connected to a drive mechanism 217 so as to be capable of being rotatably driven thereby. A plurality of grinding rolls 218, preferably three in number in accord with conventional practice, are suitably supported within the interior of the separator body 212 so as to be spaced equidistantly one from another around the circumference of the latter. A spring means 222, in a manner well-known to those skilled in the art of bowl mills, is operative to establish a spring loading on the grinding roll 218 associated therewith whereby the latter grinding roll 218 is made to exert the requisite degree of force on the material, e.g., coal, that is disposed on the grinding table 214 for purposes of accomplishing the desired size reduction of this coal.

The material, e.g., coal, that is to be pulverized in the bowl mill 210 is fed thereto by means of any suitable conventional form of feed means. By way of exemplification in this regard, one such feed means that may be employed for this purpose is a belt feeder means 224. Upon being discharged from the belt feeder means 224, the coal enters the bowl mill 210 by means of a coal supply means 226, with which the separator body 212 is suitably provided. The coal supply means 226 includes a suitably dimensioned duct 228 having one end thereof which extends outwardly of the separator body 212 and which is suitably shaped as seen at 230 so as to facilitate the collection of the coal particles leaving the belt feeder means 224, and the guiding thereafter of these coal particles into the duct 228. The other end 232 of the duct 228 of the coal supply means 226 is operative to effect the discharge of the coal on to the surface of the grinding table 214. The duct end 232 preferably is suitably supported within the separator body 212 through the use of any suitable form of conventional support means (not shown) such that the duct end 232 is coaxially aligned with the shaft 216 that supports the grinding table 214 for rotation, and is located in spaced relation to a suitable outlet 234 provided in the classifier, generally designated by reference numeral 236, through which the coal flows in the course of being fed on to the surface of the grinding table.

A gas such as air is utilized to effect the conveyance of the coal from the grinding table 214 through the interior of the separator body 212 for discharge from the bowl mill 210. The air that is used in this regard enters the separator body 212 through a duct, denoted by the reference numeral 238 that is cooperatively associated with the bowl mill 210 so as to be usable for such a purpose. From the duct 238 the air flows into the separator body 12 and through an annulus 240, which consists of the ring-like space that exists between the circumference of the grinding table 214 and the inner wall surface of the separator body 212. The air upon passing through the annulus 240 is deflected over the grinding table 214 preferably by means of a vane wheel assembly.

While the air is flowing along the path described above, the coal which is disposed on the surface of the grinding table 214 is being pulverized by the action of the grinding rolls 218. As the coal becomes pulverized, the particles are thrown outwardly by centrifugal force away from the center of the grinding table 214. Upon reaching the region of the circumference of the grinding table 214, the coal particles are picked up by the air exiting from the annulus 240 and are carried along therewith. The combined flow of air and coal particles is thereafter captured by the deflector portion 242 of the vane wheel assembly constructed in accordance with the teachings of U.S. Pat. No. 4,523,721. The effect of this is to cause the combined flow of these air and coal particles to be deflected over the grinding table 214. This necessitates a change in direction of the path of flow of this combined stream of air and coal particles. In the course of effecting this change of direction, the heaviest coal particles, because they have more inertia, become separated from the air stream, and fall back on to the surface of the grinding table 214 whereupon they undergo further pulverization. The lighter coal particles, on the other hand, because they have less inertia, continue to be carried along in the air stream.

After leaving the influence of the aforesaid deflector portion 242 of the vane wheel assembly constructed in accordance with the teachings of U.S. Pat. No. 4,523,721, the combined stream consisting of air and those coal particles that remain flow to the classifier 236 to which mention has been previously been had hereinbefore. The classifier 236, in accord with conventional practice and in a manner which is well-known to those skilled in this art, operates to effect a further sorting of the coal particles that remain in the air stream. Namely, those particles of pulverized coal, which are of the desired particle size, pass through the classifier 236 and along with the air are discharged therefrom and thereby from the bowl mill 210 through the outlets 244 with which the latter is provided for this purpose. On the other hand, those coal particles which in size are larger than desired are returned to the surface of the grinding table 214 whereupon they undergo further pulverization. Thereafter, these coal particles are subjected to a repeat of the process described above.

The bowl mill 210 is exemplary of a possible retrofit configuration in accordance with the present invention. Specifically, the bowl mill 210 represents a bowl mill in which the existing or original bowl drive motor has been replaced with a new bowl drive motor 217 which is operable to drivingly rotate the bowl at a speed higher than the pre-retrofit speed and which provides relatively more horsepower than the replaced bowl drive motor; (2) the existing or original mill gear set with a new mill gear set 242 operable to rotate the bowl at the same rotational speed as its pre-retrofit rotational speed, and (3) the existing or original exhauster fan coupling with a new exhauster fan gear set 244 which effects rotation of the exhauster fan at a relatively higher rotational speed than the pre-retrofit speed. Additionally, the exhauster fan wheel 246, which comprises the rotating fan blades and the hub on which they are mounted, may be replaced with a high efficiency exhauster fan wheel.

Variable speed exhauster drive motor controls can be added to enable soft start capability, airflow turn down and control while also enabling the ability to reach a speed higher than the pre-retrofit speed.

Figure 6:
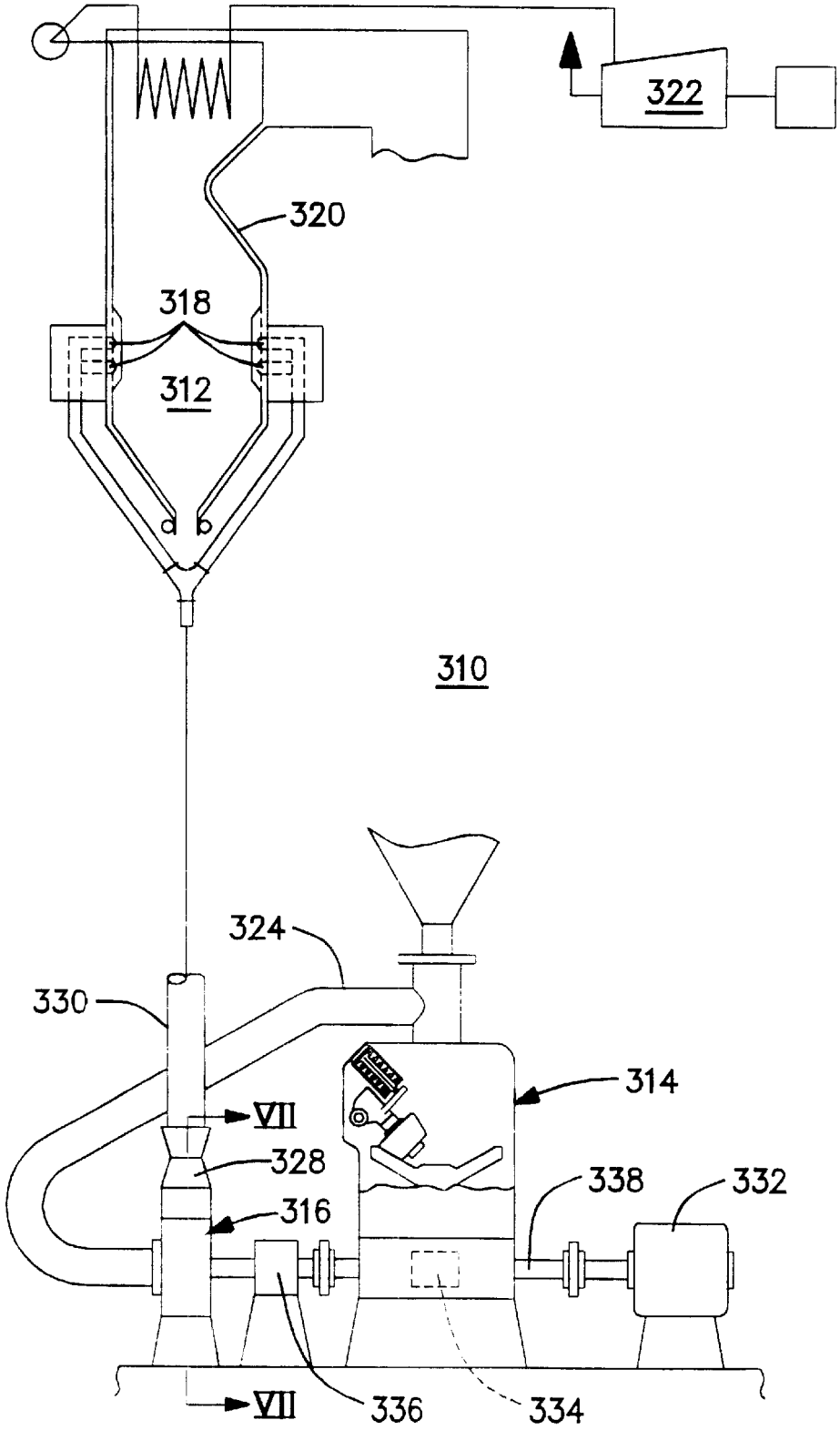
FIG. 6 is a front elevational view of an additional embodiment of the solid fuel pulverizer and exhauster system of the present invention.

Referring now to FIG. 6, there is depicted therein an additional embodiment of the solid fuel pulverizer and exhauster system of the present invention which is exemplary of a configuration for new utility unit or a configuration for retrofitting an existing utility unit in it is desired to provide with each respective configuration a common drive shaft for both the bowl of the pulverizer and the exhauster fan. This additional embodiment of the solid fuel pulverizer and exhauster system is generally designated as solid fuel pulverizer and exhauster system 310 which furnishes pulverized solid fuel to a furnace 312. The solid fuel pulverizer and exhauster system 310 comprises a pulverizer 314, and an exhauster 316, for effecting delivery of a mixture of hot gases and entrained fine solid fuel particles from the pulverizer 314 to the furnace 312. The furnace 312 operates in conventional manner to combust the pulverized solid fuel and air fed thereinto and, to this end, the pulverized solid fuel and air is injected into the furnace 312 through a plurality of burners 318. Additionally, the secondary air which is required to effectuate the combustion within the furnace 312 of the pulverized solid fuel that is injected thereinto through the burners 318. The hot gases that are produced from construction of the pulverized solid fuel and air rise upwardly in the furnace 312. During upward movement thereof in the furnace 312, the hot gases in a manner well-known to those skilled in this art give up heat to the fluid passing through the tubes 320 that in conventional fashion line all four of the walls of the furnace 312. Then, the hot gases exit the furnace 312 through a horizontal pass which in turn leads to a rear gas pass, both gas passes commonly comprising other heat exchanger surface (not shown) for generating and super heating steam, in a manner well-known to those skilled in this art. Thereafter, the steam commonly is made to flow to a turbine 322 which is in turn connected to a variable load, such as an electric generator (not shown), which in known fashion is cooperatively associated with the turbine 322, such that electricity is thus produced from the generator (not shown).

Figure 7:
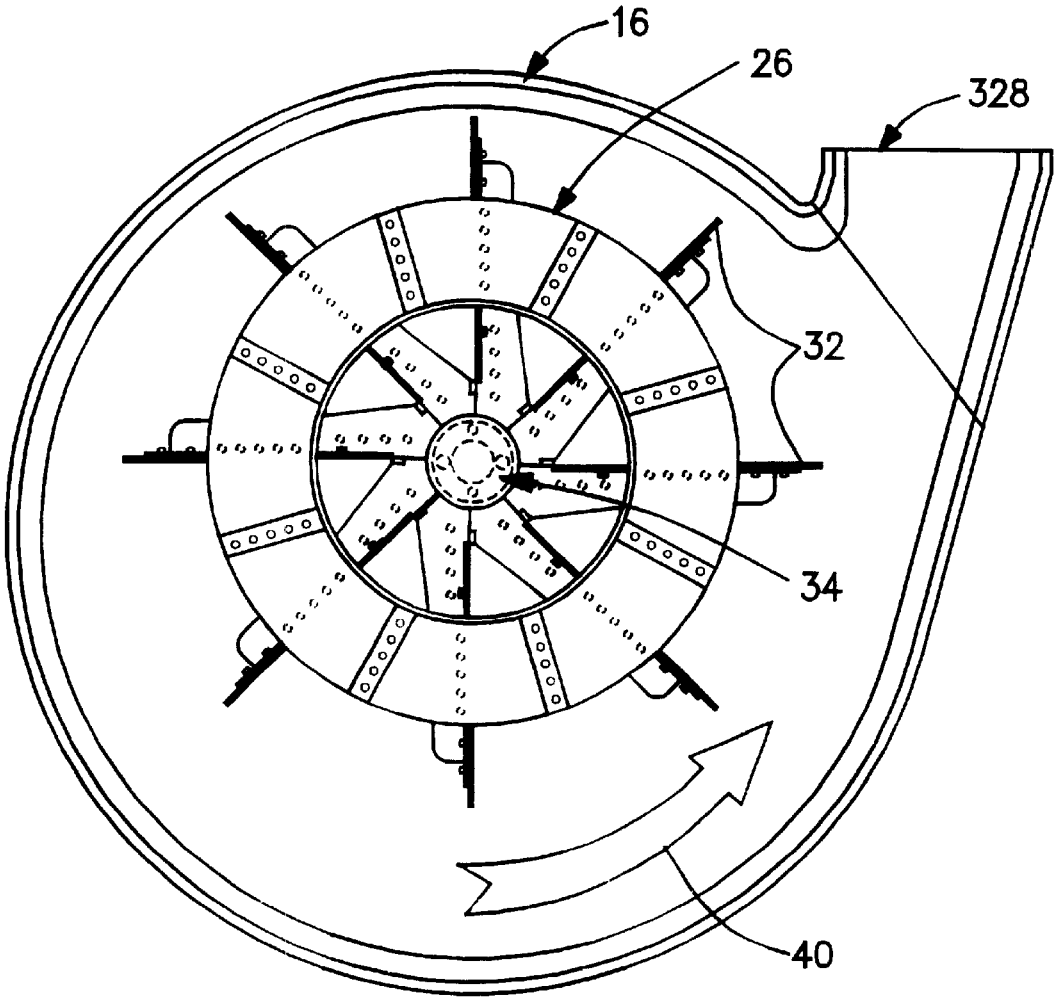
FIG. 7 is an enlarged side sectional view of the exhauster of the solid fuel pulverizer and exhauster system shown in FIG. 6 taken along lines VII—VII thereof.

A description will next be had herein of the mode of operation of the solid fuel pulverizer and exhauster system 310 illustrated in FIG. 6. To this end, solid fuel is supplied to and is pulverized within the pulverizer 314. In turn, the pulverizer 314 is connected by means of a duct 324 to the exhauster 316 whereby the solid fuel that is pulverized within the pulverizer 314 is entrained therewithin in an airstream and while so entrained therein is conveyed from the pulverizer 314 through the duct 324 to the exhauster 316. With reference now to FIG. 7, which is a front elevational sectional view of the exhauster 316 taken along lines VII—VII in FIG. 6, it can be seen that the airstream with the pulverized solid fuel entrained therewith is made to pass through the exhauster 316 by virtue of the movement of an exhauster fan assembly 326. The pulverized solid fuel while still entrained in the airstream is discharged from the exhauster 316 through an outlet 328. From the exhauster 316, the pulverized solid fuel entrained in the airstream is conveyed to the furnace 312 through the duct denoted in the drawing by reference numeral 330 in FIG. 6, whereupon the pulverized solid fuel is combusted within the furnace 312. The exhauster fan assembly 326 includes a fan 332 mounted on a shaft 334 for rotation of the fan about a shaft rotational axis. The fan 332 rotates within a housing 336 which has an inlet 338 communicated with the duct 324 and generally aligned with the shaft rotational axis such that coal entering the housing 336 through the inlet 338 contacts the rotating exhauster fan 332 and is redirected thereby along a radial outlet path. The blades 332 are mounted at uniform circumferential spacings around a hub.

As noted, the bowl mill 310 is exemplary of a possible retrofit configuration in accordance with the present invention. Specifically, the bowl mill 310 represents a bowl mill in which the existing or original mill gear set cannot satisfactorily effect the desired rotation of the bowl and/or if the existing or original bowl drive motor cannot provide the requisite rotational drive of the bowl. Thus, the bowl mill 310 is exemplary of a retrofit configuration in which: (1) the existing or original bowl drive motor has been replaced with a new drive motor 332 which is operable to drivingly rotate the bowl at the pre-retrofit speed but which provides relatively more horsepower than the replaced bowl drive motor; (2) the existing or original mill gear set has been replaced with a new mill gear set 334 operable to rotate the bowl at same speed than its pre-retrofit rotational speed, and (3) the existing or original exhauster fan coupling has been replaced with a new exhauster fan gear set 336 which effects rotation of the exhauster fan at a relatively higher rotational speed than the pre-retrofit speed. In another possible retrofit configuration, the bowl mill 310 can alternatively be provided with a replacement for the existing or original bowl drive motor in the form of a new drive motor which is operable to drivingly rotate the bowl at same speed as the pre-retrofit speed and which provides relatively more horsepower than the replaced bowl drive motor. Furthermore, in a further possible retrofit configuration, the bowl mill 310 can alternatively be configured such that the existing or original mill gear set is not replaced with a new mill gear set, such as the mill gear set 334, but is, instead, configured to continue using the existing or original mill gear set. As a further variation of a retrofit configuration, the bowl mill 310 can alternatively be configured such that the existing or original exhauster fan coupling is not replaced with a new exhauster fan gear set which effects rotation of the exhauster fan at a relatively higher rotational speed than the pre-retrofit speed, such as the exhauster fan gear set 336, but is, instead, configured to continue using the existing or original mill gear set. Additionally, as required, the exhauster fan wheel of the exhauster 316 can be replaced with a high efficiency exhauster fan wheel. Also, it is noted that, in each of the aforementioned retrofit configurations, both the fan of the exhauster 316 and the bowl of the bowl mill 314 are commonly driven by a common drive shaft 338 which is rotatively driven by the motor 332.

We claim:

1. A method for retrofitting a solid fuel pulverizer and exhauster system including at least one pulverizer acting in cooperative association with a fuel-fired steam generating power plant which includes a furnace, the at least one pulverizer operative for pulverizing material into smaller particles, the pulverizer including a rotating vertical spindle supported therewithin, a grinding table supported on the vertical spindle for rotation thereby, at least one grinding roll operable to exert a grinding force on material disposed on the grinding table for effecting the pulverization thereof, a bowl drive means for drivingly rotating the vertical spindle, a mill gear set for operably interconnecting the vertical spindle and the bowl drive means, and classifier means for classifying the pulverized solid fuel between a discharge condition in which some of the pulverized solid fuel is suitable for discharge from the at least one pulverizer to the furnace and a non-discharge condition in which the remaining pulverized solid fuel is retained in the at least one pulverizer for further pulverizing, an exhauster assembly having an exhauster housing defining an inlet opening and a fan rotatably mounted in the exhauster housing, the fan providing an air stream, fan drive means for drivingly rotating the fan, and an exhauster fan gear set for operably interconnecting the fan and the fan drive means, and a duct interconnecting the exhauster assembly and the furnace for the feed of pulverized solid fuel therealong from the exhauster assembly to the furnace, the method comprising:

replacing the bowl drive motor with a new drive motor which is operable to drivingly rotate the bowl at the pre-retrofit speed but which provides relatively more horsepower than the replaced bowl drive motor; and replacing the original exhauster fan coupling with a new exhauster fan gear set which effects rotation of the exhauster fan at a relatively higher rotational speed than the pre-retrofit speed.

2. A method for retrofitting a solid fuel pulverizer and exhauster system including at least one pulverizer acting in cooperative association with a fuel-fired steam generating power plant which includes a furnace, the at least one pulverizer operative for pulverizing material into smaller particles, the pulverizer including a rotating vertical spindle supported therewithin, a grinding table supported on the vertical spindle for rotation thereby, at least one grinding roll operable to exert a grinding force on material disposed on the grinding table for effecting the pulverization thereof, a bowl drive means for drivingly rotating the vertical spindle, a mill gear set for operably interconnecting the vertical spindle and the bowl drive means, and classifier means for classifying the pulverized solid fuel between a discharge condition in which some of the pulverized solid fuel is suitable for discharge from the at least one pulverizer to the furnace and a non-discharge condition in which the remaining pulverized solid fuel is retained in the at least one pulverizer for further pulverizing, an exhauster assembly having an exhauster housing defining an inlet opening and a fan rotatably mounted in the exhauster housing, the fan providing an air stream, fan drive means for drivingly rotating the fan, and an exhauster fan gear set for operably interconnecting the fan and the fan drive means, and a duct interconnecting the exhauster assembly and the furnace for the feed of pulverized solid fuel therealong from the exhauster assembly to the furnace, the method comprising:

replacing the original bowl drive motor with a new drive motor which is operable to drivingly rotate the bowl at substantially the same speed as the pre-retrofit speed and which provides relatively more horsepower than the replaced bowl drive motor;

replacing the original mill gear set with a new mill gear set operable to rotate the bowl at a selected one of a speed substantially the same as its pre-retrofit rotational speed and a speed greater than its pre-retrofit speed by means of a greater gear reduction ratio which effects the rotation of both ends of the input gear at a higher speed and, thus, effects the rotation of the exhauster at the speed greater than the pre retrofit speed; and replacing the original exhauster fan coupling with a new exhauster fan gear set which effects rotation of the exhauster fan at a relatively higher rotational speed than the pre-retrofit speed.

3. A solid fuel pulverizer and exhauster system acting in cooperative association with a fuel-fired steam generating power plant which includes a furnace, the solid fuel pulverizer and exhauster system comprising:

at least one pulverizer operative for pulverizing material into smaller particles, the pulverizer including a rotating vertical spindle supported therewithin, a grinding table supported on the vertical spindle for rotation thereby, at least one grinding roll operable to exert a grinding force on material disposed on the grinding table for effecting the pulverization thereof, a bowl drive means for drivingly rotating the vertical spindle, a mill gear set for operably interconnecting the vertical spindle and the bowl drive means, and classifier means for classifying the pulverized solid fuel between a discharge condition in which some of the pulverized solid fuel is suitable for discharge from the at least one pulverizer to the furnace and a non-discharge condition in which the remaining pulverized solid fuel is retained in the at least one pulverizer for further pulverizing; and an exhauster assembly having an exhauster housing defining an inlet opening and a fan, rotatably mounted in the exhauster housing, the fan providing an air stream, an exhauster fan drive motor having a drive shaft, the exhauster fan drive motor for drivingly rotating the fan, and an exhauster fan transmission assembly for operably interconnecting the fan and the fan drive means, the exhauster fan transmission assembly being operable to translate the rotation of the drive shaft of the exhauster fan drive motor through ninety (90) ninety degrees to thereby effect rotation of the fan by the exhauster fan drive motor; and a duct interconnecting the exhauster assembly and the furnace for the feed of pulverized solid fuel therealong from the exhauster assembly to the furnace.

4. Solid fuel pulverizer and exhauster system according to claim 3 wherein the exhauster fan transmission assembly includes a right angle gear set.

5. Solid fuel pulverizer and exhauster system according to claim 3 wherein the exhauster fan transmission assembly includes a worm gear set.

6. Solid fuel pulverizer and exhauster system according to claim 3 wherein the exhauster fan transmission assembly includes a hypoid.

7. Solid fuel pulverizer and exhauster system according to claim 3 wherein the exhauster fan transmission is driven by a variable speed drive system.

* * * * *